United States Patent [19]

Beeley

[11] 4,359,831

[45] Nov. 23, 1982

[54] REVERSIBLY POWERED ROTARY SNOW TILLER

[75] Inventor: Michael G. Beeley, Logan, Utah

[73] Assignee: De Lorean Manufacturing Company, Bloomfield Hills, Mich.

[21] Appl. No.: 151,427

[22] Filed: May 19, 1980

[51] Int. Cl.[3] ..... E01H 5/00

[52] U.S. Cl. ..... 37/258; 37/259; 172/112

[58] Field of Search ..... 37/10, 43 R, 43 E, 43 D; 172/46, 51-52, 63, 79, 103, 112-113, 118-119, 122, 125, 170, 193, 194, 197, 199, 200, 201

[56] References Cited

U.S. PATENT DOCUMENTS

| | | | |
|---|---|---|---|
| 2,911,734 | 11/1959 | Sublett et al. | 37/104 |
| 3,051,459 | 8/1962 | Witzenburg | 37/43 R X |
| 3,438,189 | 3/1969 | Seaman | 172/103 X |
| 3,463,548 | 8/1969 | Kelly | 37/43 R X |
| 3,746,101 | 7/1973 | Takata | 172/112 |
| 3,886,675 | 6/1975 | Maisonneuve | 37/43 R X |
| 3,892,278 | 7/1975 | Smith et al. | 172/112 X |
| 3,907,038 | 9/1975 | Nelson | 172/112 X |
| 4,019,268 | 4/1977 | Waterman | 37/10 |
| 4,042,038 | 8/1977 | Van Der Lely | 172/112 X |
| 4,057,110 | 11/1977 | Van der Lely | 172/103 X |
| 4,057,916 | 11/1977 | Roemer | 37/43 R |

*Primary Examiner*—E. H. Eickholt

*Attorney, Agent, or Firm*—A. Ray Osburn

[57] ABSTRACT

A vehicle drawn snow tiller for loosening, cutting, grinding, packing and leveling a wide path of snow for improved, more enjoyable skiing. The tiller comprises an elongate rotary snow cutter assembly with radially projecting snow cutting blades distributed over the length and about the circumference of a cutter tube directly powered by reversible hydraulic motors, one mounted upon each of its ends. The snow is cut, selectably, in or away from the direction of travel of the tiller over the snow. An elongate apron disposed over the cutter assembly collects and directs the loose cut snow onto the surface behind the cutter assembly, where it is compacted by the apron and finally leveled and smoothed by a horizontal grooming bar on the trailing edge of the apron. According to one aspect of the invention, an elongate snow splitting baffle may be disposed above the cutter to deflect a portion of the cut snow forward to fall again into the path of the reversely rotating cutter for additional cutting and grinding. According to another aspect of the invention, the cutter assembly may comprise two segments flexibly coupled at the center of the tiller to facilitate fabrication and assembly of the tiller, and to alleviate the effects of shock to the cutter. Each segment may be similarly coupled to one of the motors. The tiller may be raised from the snow to be transported upon the vehicle.

37 Claims, 16 Drawing Figures

REVERSIBLY POWERED ROTARY SNOW TILLER

BACKGROUND OF THE INVENTION

1. Field

The field of the invention is snow conditioning and grooming devices, and more particularly such devices which positively chop, grind, stir and level the snow to form a smooth firmly compacted snow surface layer adapted to enjoyable skiing.

2. State of the Art

Various snow grooming devices have been used to smooth and recondition snow surfaces, particularly for ski slopes. Generally, these devices have been drawn over the snow behind a snow grooming vehicle, which often carries a forward blade or the like for preliminary leveling of the snow surface. Unpowered harrows, rotating discs, rollers and the like have been used to break up, level, and pack the snow surface. Snow tillers, however, are powered to agressively break up and cut the snow so that the conditioned surface, while not "powder" snow, is relatively finely grained and lightly but firmly packed for easy, enjoyable skiing. Such tillers comprise elongate snow tilling elements, are rotationally powered by vehicle power takeoffs or by separate independent engines, and have projecting snow cutting blades, spikes or the like. These monolithic snow tilling elements have been limited in length or have been undesirably massive to avoid excessive bending stresses. The framing for mounting such tiller elements is difficult and expensive to construct because the tiller end bearings are widely spaced yet must be aligned to close tolerances. Since the close alignment must be maintained during use, such frames must often be undesirably massive to limit distortion during use. Present tiller elements are often driven by a single engine mounted upon the frame. This complicates the frame construction and further detracts from its dimensional stability, because of the weight of the single motor. The need for a chain drive or other power transmission means adds further complication and expense into tiller construction. The snow cutting assemblies of present snow tillers are powered for rotation in a single direction, so that tiller operation is slowed undesirably when the snow is firmly packed or icy, unless undesirably large tiller motors are provided.

BRIEF SUMMARY OF THE INVENTION

With the foregoing in mind, the disadvantages of present snow tillers are eliminated or significantly alleviated by the present invention which provides a vehicle drawn snow tiller having an elongate snow cutter assembly rotatably mounted at each of its ends upon a tiller frame, and at least one motor coupled to one of the ends of the cutter assembly, or, preferably, a pair of motors, one coupled to each of said ends. The motors provide rotational power to the cutter assembly, which preferably comprises two axially aligned longitudinal segments flexibly coupled at the center of the tiller. Preferably, the output shaft of each motor is coupled axially to an end of the cutter assembly, to be supported thereon with only a torsion linkage being provided between the motor and the frame of the tiller. The coupling between each motor and the cutter assembly may also be flexible. The motors are preferably reversible so that the snow may be tilled selectably both with and away from the direction of travel of the tiller. Hydraulic motors are preferred, operated by pressurized hydraulic fluid from the vehicle, although other motor types may be employed. A snow gathering apron is provided over the cutter assembly, which lightly packs the cut snow behind the cutter assembly, and terminates at its trailing edge in an elongate grooming bar finally leveling the snow. A snow splitting baffle may be employed above the cutter assembly to forwardly deflect a portion of the cut snow ahead of the cutter assembly for further conditioning. Also, a roller may be affixed to the tiller behind the apron to further compact the conditioned snow when desired, and to press any balls of snow rolled up by the apron firmly into the snow surface.

It is therefore a principal object of the invention to provide a rotary powered snow tiller to effectively till and condition a wide path of snow under severe snow surface conditions with the provision of minimum rotary power. Another object is to provide a durable and serviceable tiller economically constructed without employing unduly massive and rigid framing, and without snow cutting components or framing constructed to unnecessarily close tolerances.

DETAILED DESCRIPTION OF ILLUSTRATED EMBODIMENTS

Figure 1:
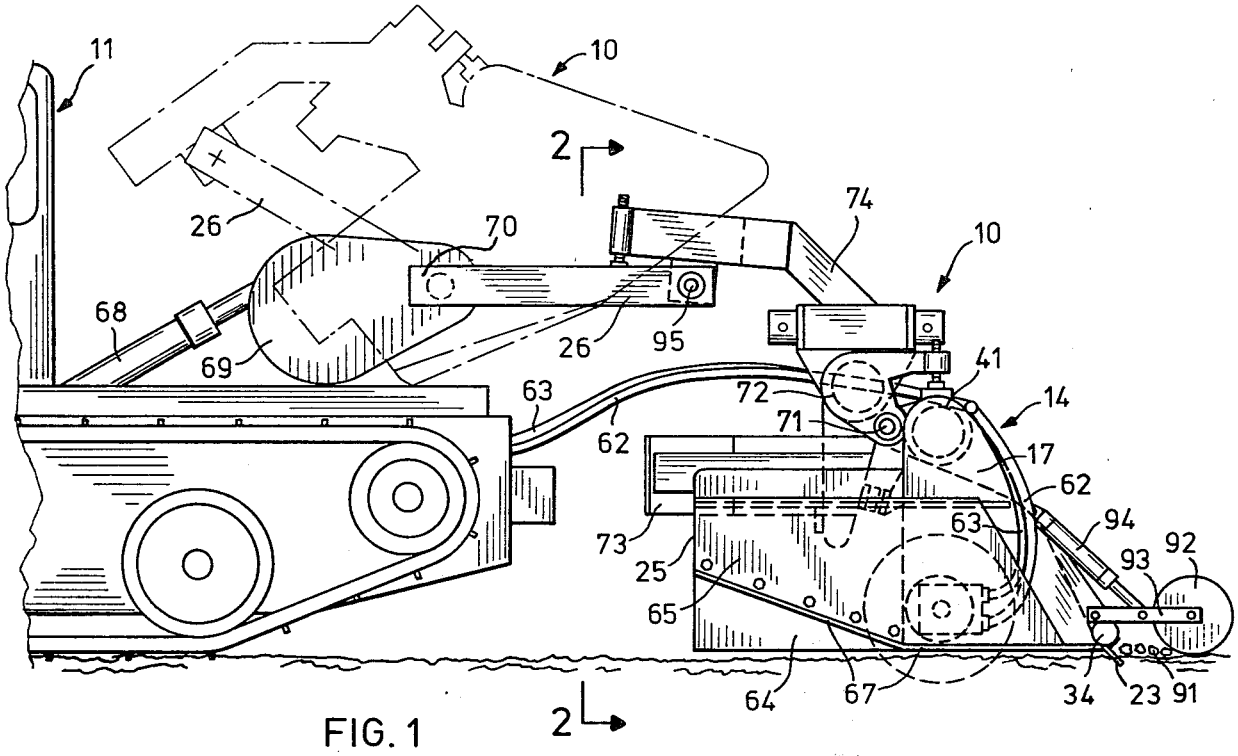
FIG. 1 is a side elevational representation of the snow tiller of the invention in snow tilling position and being drawn over the snow by a suitable vehicle, partially shown, the tiller being also indicated by dashed lines in its carrying position upon the vehicle.
Figure 3:
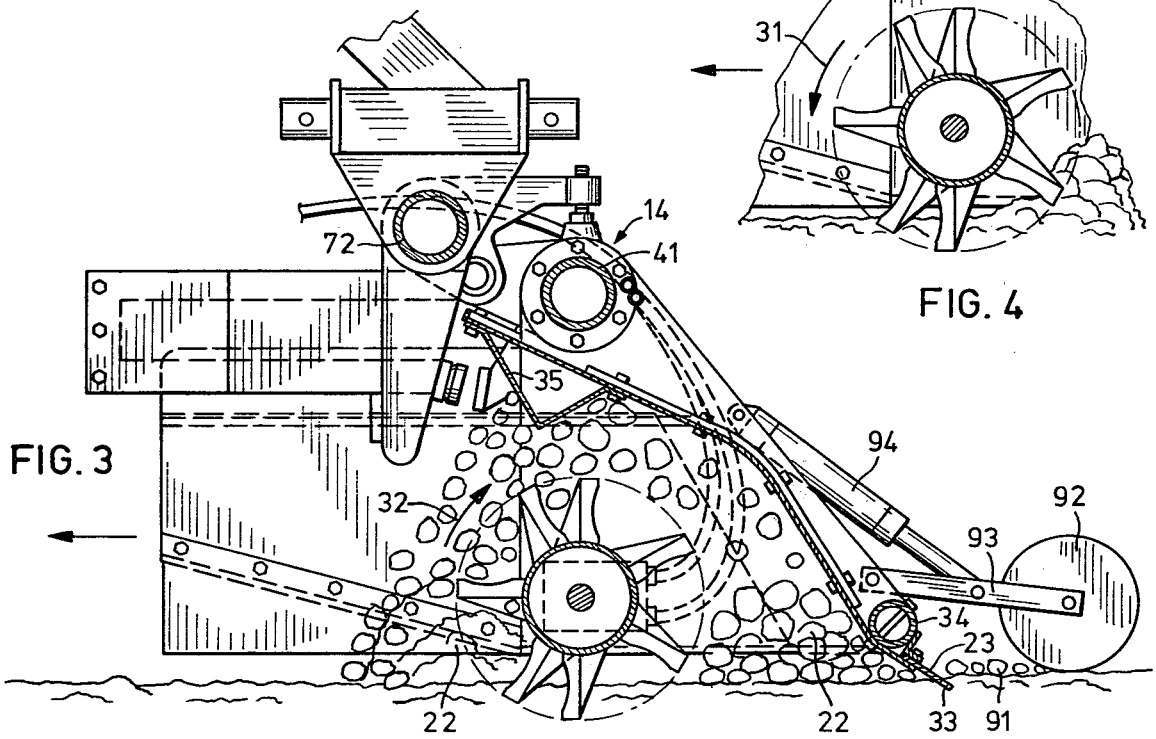
FIG. 3 is an enlarged cross-sectional representation taken along line 3—3 of FIG. 2, the snow cutter assembly being represented in reverse rotation.
Figure 10:
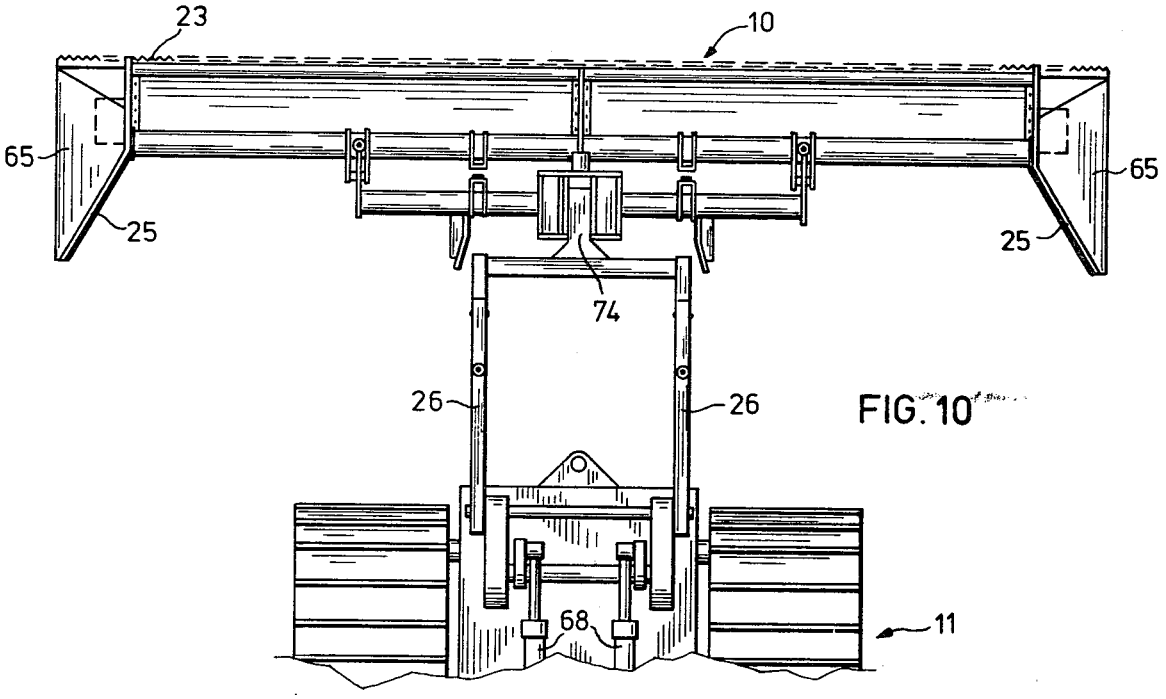
FIG. 10 is a reduced scale top view of the tiller of FIG. 1.
Figure 11:
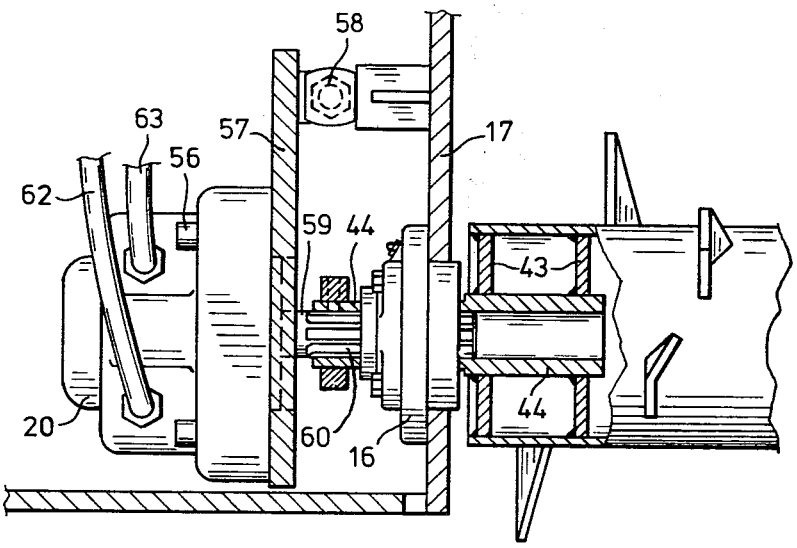
FIG. 11 is an enlarged fragmentary cutaway front representation of one of the ends of the tiller of FIG. 2, showing details of one embodiment mounting one of the hydraulic motors to one of the ends of a cutter segment.

In FIG. 1, the snow tiller of the invention, generally 10, is illustrated attached in snow tilling position to a tracked vehicle 11, and by dashed lines in carrying position upon vehicle 11. Tiller 10 comprises an elongate snow cutter assembly, generally 12, having a multiplicity of projecting cutting blades 13. (FIG. 2) Snow cutter assembly 12 is supported within a tiller main frame, generally 14, at each of its outermost ends 15 through one of a pair of piloted flange, self aligning bearings 16 to one of two frame end plates 17, (FIG. 11) and through a center self aligning bearing 18 carried by a center support plate 19. (FIGS. 13 and 14) The cutter assembly 12 is rotated to cut the snow by a pair of reversible hydraulic motors 20 each engaging one of its outer ends 15. An elongate snow apron 21 is carried by main frame 14 over cutter assembly 12. Apron 21 extends rearwardly and downwardly over cutter assembly 12, so that the snow 22 cut and thrown by rotating blades 13 is collected and deposited behind cutter assembly 12 to be smoothed and leveled by a serrated snow grooming bar 23 secured to the trailing edge of apron 21 at the finish grade level of the snow. (FIG. 3) A pair of sledding structures 24 are shown each extending outwardly from main frame 14. A pair of snow gathering wings 25 each diverge forwardly from main frame 14, to prevent windrowing of any snow which may be scattered sidewardly from cutter 12. (FIG. 5) A towing frame 26 is provided on vehicle 11 for drawing tiller 10 over the snow, acting through a linking "T" frame 27 and an oscillation frame 28 attached to tiller main frame 14. (FIG. 10) These frames are connected together pivotally so that tiller 10 may be raised above and carried upon vehicle 11, as indicated in FIG. 1 and further described hereinafter. In this illustrated embodiment of the invention, snow cutter assembly 12 comprises two generally coaxial segments 29 (right) and 30 (left) of equal length joined flexibly at the center of tiller 10, for purposes hereinafter more fully described and explained.

Figure 4:
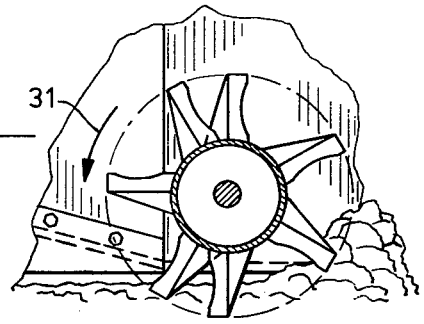
FIG. 4 is a fragmentary representation of the tiller as shown in FIG. 3, the snow cutter assembly, however, being represented in forward rotation.

Snow cutter assembly 12 may be rotated either "forwardly" with blades 13 cutting the snow oppositely to the direction of travel, or "reversely," with the snow being cut toward the direction of travel. In FIG. 4, cutter assembly 12 is rotated forwardly by reversible motors 20 and reversely in FIG. 3 as indicated by arrows 31 and 32 respectively. By control of the rate of rotation of cutter assembly 12, the operator may control the degree to which the snow is conditioned. Blades 13 of cutter assembly 12 till the surface layer of the snow and propel the cut snow to the rear to be collected and compressed by apron 21 and leveled by grooming bar 23. As described hereinafter, cutter assembly 12 may also be released to rotate freely from contact with bare or thinly snow covered ground or paved surfaces that tiller 10 may be required to traverse from time to time. Such thin snow can be thus tilled without undue mixing with overly disturbed soil, and damage to paved surfaces is largely avoided.

The loose cut snow 22 behind cutter assembly 12 is wedged downwardly and compacted by apron 21 before being finally smoothed and leveled by combing teeth 33 of grooming bar 23, with tiller 10 supported upon the snow by grooming bar 23 stiffened by cross tube 34. Occasionally, when a more loosely packed snow path is desired, tiller 10 may be tilted forward to ride upon lower sled plates 67 of sledding structures 24, apron 21 then collecting, but not packing, the cut snow 22 before it is leveled by grooming bar 23.

When cutter assembly 12 is rotated reversely, (FIG. 3), the snow 22 is thrown partially ahead and partially behind cutter assembly 12. The forwardly thrown snow, which may tend to larger chunks, is repeatedly cut until eventually reduced to smaller size and also drawn rearwardly over cutter assembly 12. An undesirably large amount of the larger snow chunks sometimes tends to be carried over and to the rear of rotating cutter assembly 12, so that a V-shaped snow splitter 35 is provided to deflect a larger portion of the initially cut snow 22 ahead of cutter assembly 12 for further conditioning. The illustrated snow splitter 35 is in fixed position selected for efficient forward deflection of the approximate amount of cut snow. However, it is desirable that its position be selectable in height and forward or rearward relation to cutter assembly 12, as may be advantageous with varying snow conditions. Provisions for such selectable position of snow splitter 35 are easily accomplished, although not illustrated herein. Reverse rotation of cutter assembly 12 effectively tills crusty or icy snow surfaces which may not be easily broken up by forward rotation. Also, reverse rotation of cutter assembly 12 helps to brake the vehicle on sharply descending slopes, and forward rotation helps to propel the vehicle for abruptly ascending slopes.

Occasionally, snow conditions are such that apron 21 and/or grooming bar 23 rolls some of the cut snow into small spheroids 91 which remain upon the snow surface behind tiller 10. (FIG. 1) These balls of snow 91 may then freeze and roll beneath skiis, being therefore highly undesirable. To prevent this, tiller 10 may comprise also a roller 92 to crush the snow balls 91 or to press them into the snow surface to blend therewith. Roller 92 is rotatably mounted upon a pair of roller arms 93 each pivotally secured to tiller 10, preferably through frame end plates 17. A pair of controllable hydraulic cylinders 94, each installed between a frame plate 17 and a roller arm 93, serve to press roller 91 against the snow.

Figure 15:
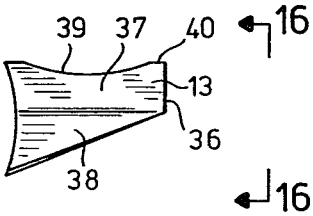
FIG. 15 is a side elevational view of one of the snow cutting blades before its attachment to the cutter assembly of the invention.
Figure 16:
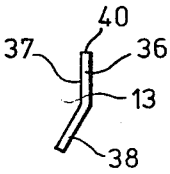
FIG. 16 is a view of the cutting blade taken along line 16—16 of FIG. 15.

The configuration, placement, and number of blades 13 may be selected to best cut and break up the snow. For example, pointed spike or disc-like shapes may be employed. One satisfactory blade structure, shown in FIGS. 15 and 16, comprises a shaped portion of steel plate having a substantially square cutting end 36, a forward cutting portion 37 oriented normal to the surface of the snow, and a rearward portion 38 angled toward the center of cutter assembly 12 and tiller 10. The square corners concentrate force to efficiently pierce the surface of the snow, an effect which is enhanced by an inward radius 39 on leading edge 40 of blade 13. The cutter blades 13 are evenly disposed about and along each cutter segment 29 and 30 along two intersecting, constant pitch helical paths 75, displaced apart in this embodiment by about 210 degrees. (FIG. 2) Each cutter segment 29 and 30 acts to distribute some of the cut snow laterally toward the center of tiller 10 to fill depressions and level local mounds of snow. This urging of the snow to the center also helps to evenly distribute the snow gathered by wings 25.

Figure 2:
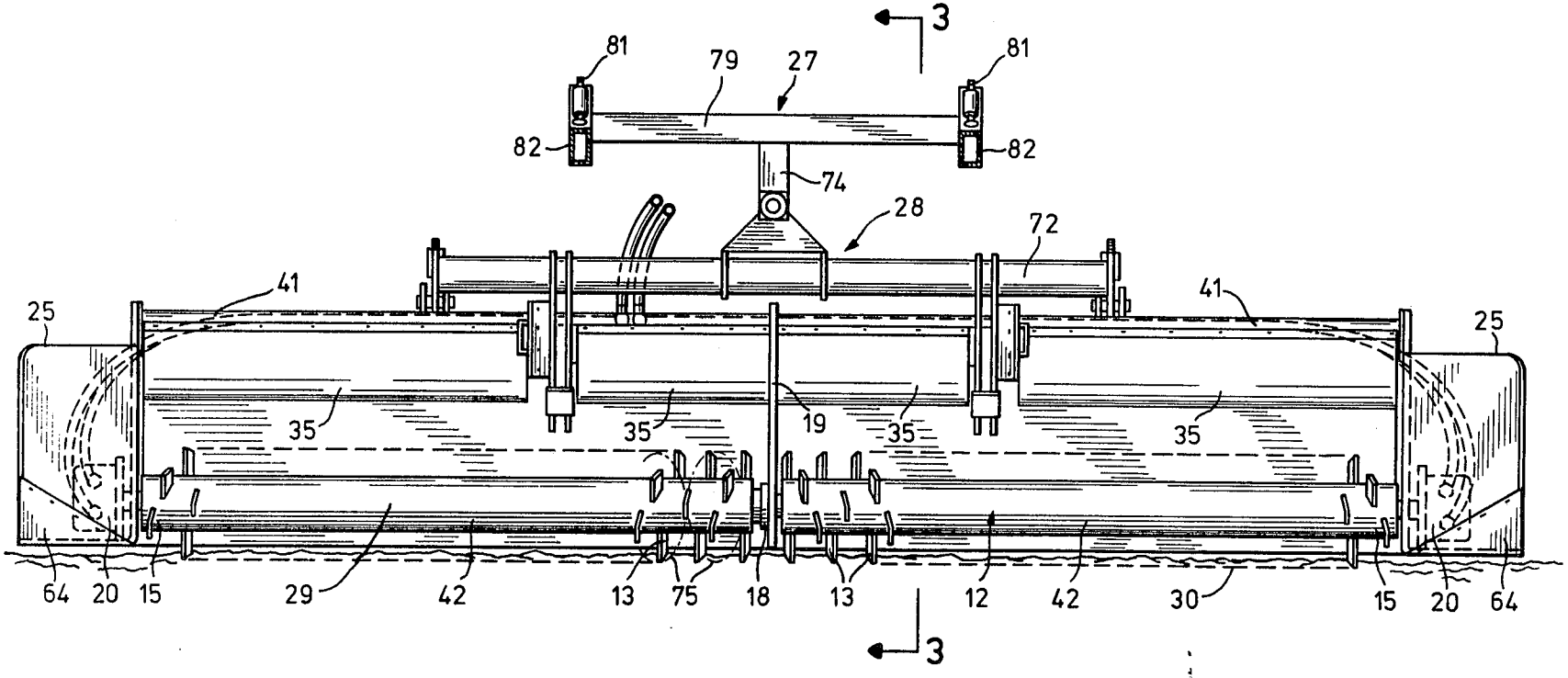
FIG. 2 is a front elevational representation of the snow tiller of FIG. 1.

If constructed monolithically and unsupported its full length, cutter assembly 12 would tend to flex excessively under load unless constructed undesirably massively. Excessive lateral rotation of its ends would then occur, and it would be difficult to provide properly functioning end support bearings 16. Rotation permitting center support of such a monolithic cutter assembly would be both desirable and feasible, in a manner not however illustrated. Tiller main frame 14, comprising principally a main frame tube 41 and end frame plates 17, unless constructed quite massively, also tends to distort significantly, and it is difficult to build such a frame to close dimensional tolerances. To alleviate these problems of cutter assembly flexure, frame distortion, and restrictive fabrication tolerances, cutter assembly 12 is constructed of the two separate cutter segments 29 and 30 of equal length flexibly coupled together at a center support plate 19 as seen in FIG. 2.

Each cutter segment 29 and 30 comprises a blade carrying elongate cutter tube 42 closed at its outermost end 15 to tiller 10 with closing plates 43 welded inside tube 42, and utilized to support projecting axle 44 welded thereto. (FIG. 11) Axle 44 is supported by a piloted flange, self aligning end bearing 16 secured to vertical end frame plate 17. End frame plates 17 are each secured by bolts 45 to main frame tube 41 through a bolt plate 46 welded thereon. Main frame tube 41 extends substantially the length of the tiller and with the end framing plates 17 principally comprises the tiller main frame 14.

A flexible coupling 47 is installed within the innermost end 48 of each cutter tube 42. (FIG. 14) Each flexible coupling 47 comprises a generally square elastic insert 49 mounted into a matching square recess 50 in an insert retainer 50*a* secured to the interior of tube 42. A center bushing 51 is bonded to elastic insert 49 to accept an end of a coupling axle 52 installed through the piloted flange, self aligning bearing 18 secured to center support plate 19. Keys 53, each inserted in one of the keyways 54 of coupling axle 52 and one of the keyways 55 of bushings 51, prevents relative rotation of the cutter segments 29 and 30 and bushings 51. Elastic insert 49 permits substantial torsional deflection to absorb rotational shocks to which either cutter segment 29 or 30 may be subjected when rocks or the like are encountered. Translational displacements of the outer ends 15 of the cutter segments, and of center support plate 19, are absorbed by distortion of elastic inserts 49.

Figure 13:
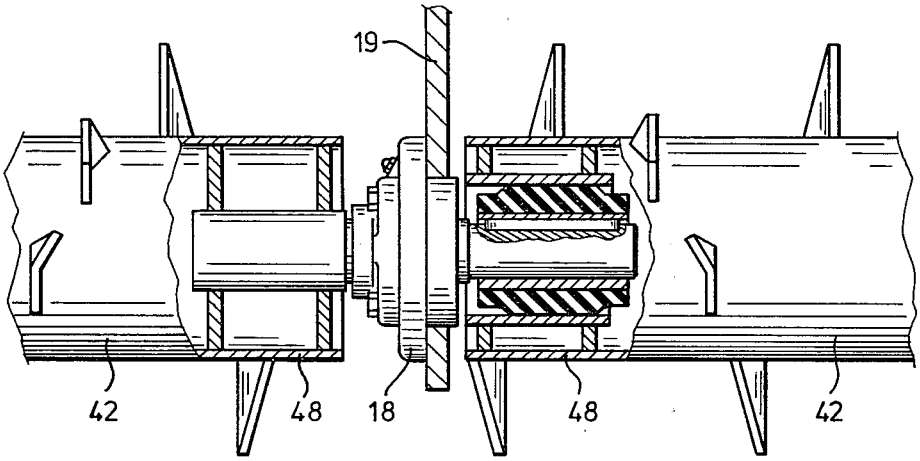
FIG. 13 is an enlarged elevational fragmentary cutaway representation showing details of one embodiment of the flexible coupling joining the cutter segments.
Figure 14:
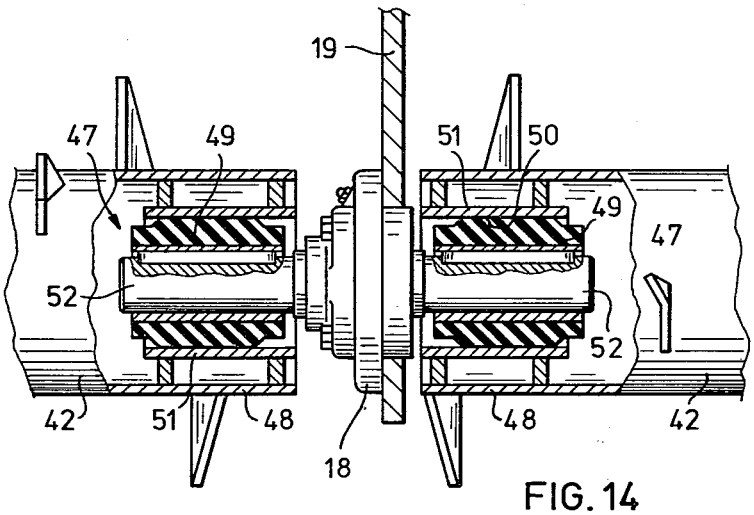
FIG. 14 is an enlarged elevational fragmentary cutaway representation showing details of another embodiment of the flexible coupling joining the cutter segments.

A satisfactory, though not preferred, variation of the above-described method of coupling the two cutter segments is shown in FIG. 13. A flexible coupling 47 is provided in only one of the tube ends 48. The coupling axle 52 is secured rigidly to and projects from the other one of the cutter tubes 42 and extends through the center self aligning bearing 18, to engage flexible coupling 47. Either method of coupling cutter segments 29 and 30 allows the tiller main frame 14 to be constructed of reasonably light components manufactured and assembled to reasonable tolerances, resulting in a desirably light weight, yet rugged and serviceable tiller 10 capable of conditioning a wide path of snow. This type of flexible coupling provides the substantial yet limited flexing needed in such a snow tiller design. It is further much more durable than gear type flexible couplings, such as flexible spline connectors, or universal type mechanical couplers. Further, repair of the couplings 47 generally requires only the replacement of the elastic inserts 49.

Hydraulic motors 20 may be each secured by motor mounting bolts 56 to a motor mounting plate 57, which is in turn secured to the adjacent one of the frame end plates 17 by an adjustable torsion linkage 58 to prevent rotation of the housing of motor 20. (FIGS. 5 and 6) Each hydraulic motor 20 has a drive shaft 59 extending into and keyed to a projecting endmost portion 60 of axle 44, to provide rotary power directly to cutter assembly 12, without chain drives, gearing or other power transmission provisions. This method of mounting of the motors 20 assures that the motor drive shafts 59 are always in driving position aligned with axle 44 regardless of any distortion of any part of main frame 14.

Figure 12:
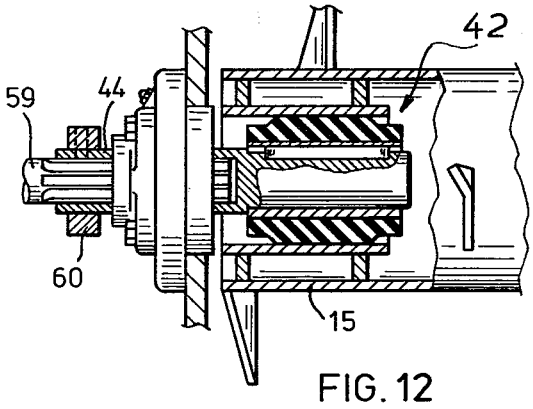
FIG. 12 is an enlarged fragmentary cutaway front representation of one of the ends of the tiller of FIG. 2, showing details of another method of mounting the motor.

The above described method of coupling motors 20 rigidly to the cutter assembly 12 does not, however, provide protection of motors 20 from the aforementioned rotational shocks to the cutter segment. Accordingly, the method now described and illustrated in FIG. 12 is preferred. With this method, each projecting axle 44 is retained within a flexible coupling 61, similar or identical to coupling 47 and provided within the outermost end 15 of each cutter segment. With this motor coupling method, the motors are also protected from rotational shocks to the cutter segments.

Both motors 20 are operated simultaneously by hydraulic fluid supplied through one of a pair of hydraulic fluid supply lines 62 connected through a tee, not shown, to a common source of pressurized hydraulic fluid carried by vehicle 11. (FIGS. 1 and 11) A pair of fluid return lines 63 convey used hydraulic fluid back to vehicle 11 for subsequent re-use. Valving, not shown, is provided to reverse the direction of flow of the fluid through both motors 20 to reverse the rotation of the drive shafts 59 and the snow cutter assembly 12. To release cutter assembly 12 to freely rotate, the vehicle operator may uncouple the fluid pressurizing pump on the vehicle and open appropriate valving on vehicle 11 so that the motors 20 may be freely rotated as cutter assembly 12, is rotated by contact of blades 13 with the snow, bare ground or paved surface. While reversible hydraulic motors 20 are preferred, suitable reversible electric motors could be satisfactorily employed in their place. Or, combustion engines could be utilized if linked to axles 44 by a suitable reversible gearing, which should also provide for disengaging the axles 44 or the drive shafts 59 of such engines.

Figure 5:
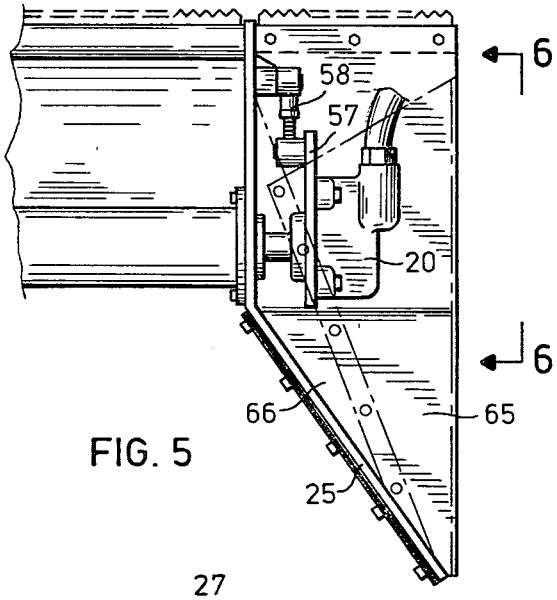
FIG. 5 is an enlarged scale fragmentary representation of the tiller of FIG. 1 being a top view of one end thereof.
Figure 6:
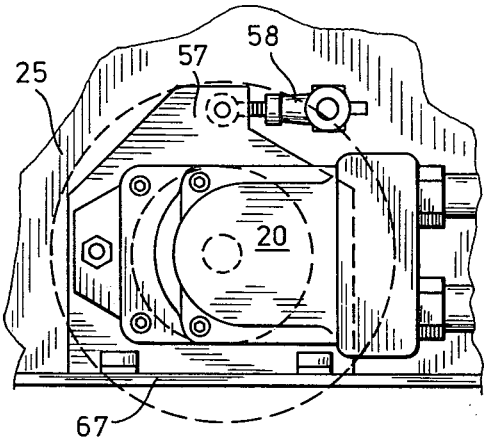
FIG. 6 is an enlarged fragmentary cutaway side elevational representation of the tiller of FIG. 1 showing one of the hydraulic motors.

The pair of snow wings 25, secured to end frame plates 17 and sled structures 24, diverge forwardly and outwardly from near the ends of cutter assembly 12. A lower, flexible triangular portion 64 of wing 25 flexes upon contact with crusted snow to help prevent deflection or shock to tiller 10. The wings 25 also serve in this illustrated embodiment to protect motors 20 and portions of hydraulic lines 62 and 63 from impact with snow or other objects. Each motor 20 is further shielded by an inwardly and upwardly angled side plate 65, attached to a wing stiffening plate 66 and to a lowermost sled plate 67 being part of sledding structure 24. (FIGS. 1 and 5)

The towing frame 26 of vehicle 11 is powered by a pair of vehicle mounted hydraulic actuators 68 which act through a chain and sprocket unit 69 to rotate end 70 of towing frame 26 to raise and lower tiller 10. (FIG. 1) A pair of spaced apart, coaxial linking frame pivot pins 71, connecting linking frame 27 and towing frame 26, permit substantially 180 degrees of rotation, so that linking frame 27 and tiller 10 may be elevated above vehicle 11 for ready transport, with tiller 10 supported upon towing frame 26. As tiller 10 is raised, tiller main frame 14 pends from a pair of coaxial main frame pivot pins 71 joining said frame to oscillation tube 72 of oscillation frame 28. A pair of guide wings 73 embrace towing frame 26 thereabout, rotating tiller 10 to rest thereupon.

Figure 7:
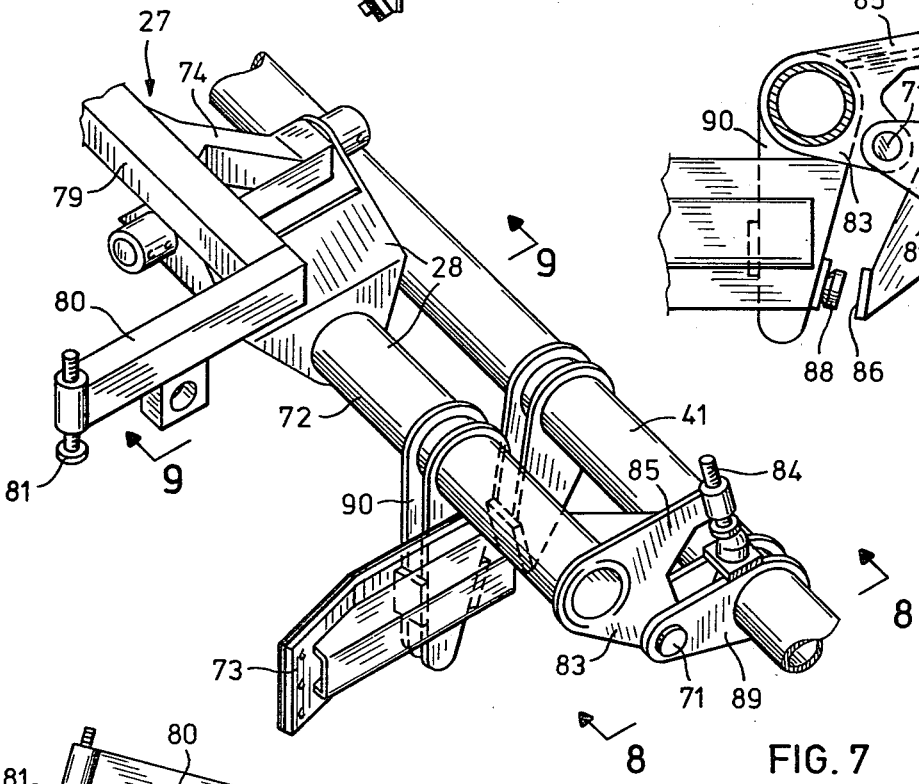
FIG. 7 is an enlarged fragmentary perspective representation of the linking, oscillation and main frames of the tiller of FIG. 1.
Figure 9:
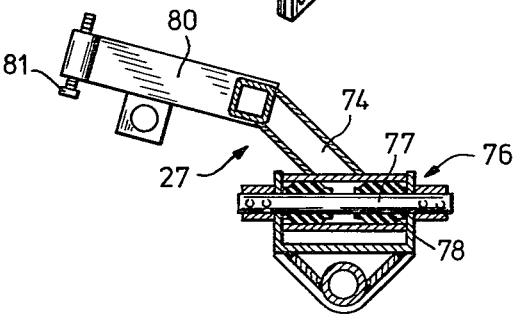
FIG. 9 is a cross-sectional representation taken along line 9—9 of FIG. 8 and showing details of the oscillation coupling of the tiller of FIG. 1.

Stem 74 of linking "T" frame 27 is secured to oscillation frame 28 through an oscillation coupling 76, secured to oscillation tube 72. (FIGS. 7 and 9) Oscillation coupling 76 permits tiller 10 to twist about a coupling spindle 77 in response to irregularities in the surface of the snow, so that tiller 10 may continue to till the snow path evenly. Tiller 10, linking "T" frame 27, and towing frame 26 are thus relieved of severe bending and torsional stress otherwise caused by such irregularities. Elastic oscillation damping bushings 78 are provided about spindle 77, prevent excessively free, loose oscillation of tiller 10, a feature which is especially desirable when tiller 10 is raised off the snow toward its carrying position.

Forward cross member 79 of linking "T" frame 27 carries at each end a pair of forwardly projecting arms 80 with "T" frame adjusting screws 81 which act against the tops of side frame members 82 of towing frame 26 to apply a positive downward force through linking "T" frame 27 to urge tiller 10 firmly down against the snow.

Figure 8:
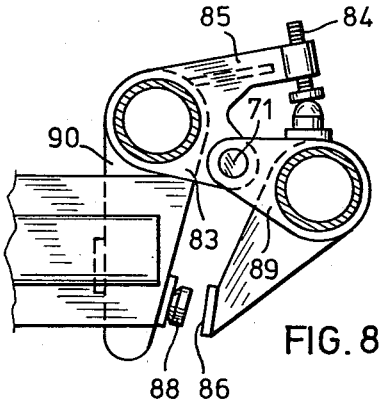
FIG. 8 is a cross-sectional representation taken along line 8—8 of FIG. 7.

Tiller 10 is rotatably attached to oscillation tube 72 through the pair of spaced apart coaxial main frame pivot pins 71 which connect a pair main frame tube gussets 89 to a pair of pivot plates 83 secured to oscillation tube 72. (FIGS. 7,8 and 9) A pair of tiller adjusting screws 84 carried by arms 85 of pivot plates 83 restrict the rearward rotation of tiller 10 about main frame pivot pins 71 so that tiller 10 is restrained from excessive upwardly rearward tilting, but is held in proper attitude with grooming bar 23 at proper elevation to finally level the conditioned snow. While tiller 10 is lifted as described above for transport, projecting end 86 of arm 87 secured to main frame tube 41 rests against a pad 88 carried by a tiller support gusset 90 secured to oscillation tube 72.

Many variations of the above described embodiments of tiller 10 may be employed without departing from the essential spirit of the invention. Although the use of two motors 20 is preferable and quite advantageous, cutter assembly 12 could be powered by a single such motor, preferably coupled directly to an end of flexibly coupled assembly 12 as described herein, but acceptably otherwise connected and/or otherwise located on the frame 14. The flexible cutter assembly 12 may be rotated by a power takeoff from vehicle 11 without departing from the spirit of the invention. As described, the sledding structures 24 are largely inoperative in supporting tiller 10 upon the snow, and are not essential. While these structures 24 serve to help protect motors 20, such protection is not essential, and other motor shielding means could be equally or more advantageously employed. For some applications, it may prove desirable to employ three or more flexibly coupled cutter segments. Other types of flexible couplings then those described could be employed, if allowing lateral flexing and providing rotational shock protection. As discussed, center support of the cutter assembly may not always be essential nor desirable. The self aligning bearings could be of various types other then the piloted flange types referred to in the foregoing description. The embodiments described herein are for illustrative purposes only, and the invention is not restricted thereto. All embodiments within the length and breadth of the appended claims, and all equivalents thereof, are intended to be embraced therein.

I claim:

1. A rotary powered snow tiller adapted to be propelled over the snow by a suitable vehicle and controlled by the operator of the vehicle, said tiller comprising:

a generally elongate tiller main frame;

an elongate generally rigid snow cutter assembly secured rotatably generally at each of its ends to the main frame and having a multiplicity of outstanding snow cutting teeth, said cutter further having two elongate cutter segments of generally equal length; and flexible bushing means connecting the two cutter segments generally coaxially together in lateral and rotational flexing relationship;

a pair of motor means adapted to together rotate the snow cutter assembly, a one of said pair secured to the main frame in the vicinity of each one of the ends of said assembly; and a snow directing apron mounted upon the frame generally over the cutter assembly substantially the full length thereof and extending rearwardly downward to a generally horizontal trailing edge.

2. The tiller of claim 1 wherein:

the motor means are each reversible, so that the direction of rotation of the snow cutter assembly may be selected by the operator.

3. The tiller of claim 2, further comprising:

elongate, snow contacting roller means secured to the tiller main frame and positioned parallel to and following the trailing edge of the apron.

4. The tiller of claim 1 wherein:

the motor means are each further adapted so that the operator may render the cutter assembly freely rotatable.

5. The tiller of claim 1 wherein:

the motor means are each reversible so that the direction of rotation of the snow cutter assembly may be selected by the operator; and the motor means are each further adapted so that the operator may render the snow cutter assembly freely rotatable.

6. The tiller of claim 1, further comprising:

elongate snow splitting means extending substantially the full length of the snow cutter generally parallel thereto and generally above the snow cutting teeth, for deflecting a portion of the cut snow forwardly of the reversely rotated cutter assembly for re-cutting.

7. The tiller of claim 6, wherein:

the reversible motor means each comprises a reversible hydraulic motor operated by pressurized hydraulic fluid supplied from the vehicle.

8. The tiller of claim 7 wherein:

the output shaft of each reversible hydraulic motor is adapted to directly coaxially engage the outermost end of one of the cutter segments so as to support the motor thereon; and the housing of the motor is secured unrotatably to the main frame.

9. The tiller of claim 8 further comprising:
means further supporting the snow cutter assembly rotatably upon the main frame in the vicinity of the longitudinal center thereof.

10. The tiller of claim 9, further comprising:
a pair of generally upstanding snow gathering wings each secured to the frame to extend forwardly and outwardly from the vicinity of one of the outermost ends of the cutter bar.

11. The tiller of claim 2 wherein:
the reversible motor means each comprises a reversible electric motor.

12. The tiller of claim 2 wherein:
the reversible motor means each comprises a constant direction motor means reversibly geared through its output shaft to the cutter assembly.

13. A rotary powered snow tiller adapted to be propelled over the snow by a suitable vehicle and controlled by the operator of the vehicle, said tiller comprising:
a generally elongate tiller main frame;
an elongate generally rigid snow cutter assembly secured rotatably generally at each of its ends to the main frame and comprising two elongate cutter segments of generally equal length and flexible bushing means connecting the two cutter segments generally coaxially together in lateral and rotational flexing relationship, each segment having a multiplicity of outstanding, snow cutting teeth;
motor means adapted to rotate the snow cutter assembly; and
a snow directing apron mounted upon the frame generally over the cutter assembly substantially the length thereof and extending rearwardly downward to a generally horizontal trailing edge.

14. The tiller of claim 13, further comprising:
elongate, snow contacting roller means secured to the tiller main frame and positioned parallel to and following the trailing edge of the apron.

15. The tiller of claim 13, wherein:
the motor means is reversible, so that the snow cutter assembly may be selectably rotated both forwardly and reversely.

16. The tiller of claim 15, further comprising:
means further supporting the snow cutter assembly rotatably upon the main frame in the vicinity of the longitudinal center thereof.

17. The tiller of claim 13, wherein the tiller main frame comprises:
a main frame tube generally parallel to, above and the length of the snow cutter assembly; and
a pair of frame end plate members one of each rigidly secured generally perpendicularly to the main frame tube at each of the ends thereof to extend generally downwardly therefrom, each member being adapted for securement of a self aligning bearing thereto for rotationally supporting the adjacent end of the cutter assembly.

18. A rotary powered snow tiller adapted to be propelled over the snow by a suitable vehicle and controlled by the operator of the vehicle, said tiller comprising:
a generally elongate tiller main frame;
an elongate generally rigid snow cutter assembly secured rotatably generally at each of its ends to the main frame and comprising two elongate cutter segments of generally equal length and flexible bushing means connecting the two cutter segments generally coaxially together in lateral and rotational flexing relationship, each segment having a multiplicity of outstanding, snow cutting teeth;
power takeoff means from the vehicle adapted to rotate the snow cutter assembly; and
a snow directing apron mounted upon the frame generally over the cutter assembly substantially the length thereof and extending rearwardly downward to a generally horizontal trailing edge.

19. The tiller of claim 18, further comprising:
elongate, snow contacting roller means secured to the tiller main frame and positioned parallel to and following the trailing edge of the apron.

20. The tiller of claim 19, wherein:
the power takeoff means is adapted to selectably rotate the cutter assembly forwardly and rearwardly.

21. A rotary powered snow tiller adapted to be propelled over the over the snow by a suitable vehicle and controlled by the operator of the vehicle, said tiller comprising:
a generally elongate tiller main frame;
an elongate generally rigid snow cutter assembly secured rotatably generally at each of its ends to the main frame and having a multiplicity of outstanding snow cutting teeth, said cutter further having two elongate cutter segments of generally equal length; and means connecting the two cutter segments generally coaxially together in flexible relationship, said connecting means comprising;
an axle member rigidly secured to and extending axially from an end of one of the cutter segments, and an elastic insert fixedly secured axially to the other one of the cutter segments within an end portion thereof, said elastic insert comprising an insert block of resilient elastic material disposed generally about the longitudinal axis of the cutter segment, having an outer longitudinal peripheral surface fixedly secured to the cutter segment, and having a perforation axially therethrough adapted to accept removably therein an end portion of the axle member in rotationally fixed relationship with the periphery of said perforation;
a pair of motor means adapted to together rotate the snow cutter assembly, a one of said pair secured to the main frame in the vicinity of each one of the ends of said assembly; and
a snow directing apron mounted upon the frame generally over the cutter assembly substantially the full length thereof and extending rearwardly downward to a generally horizontal trailing edge.

22. A rotary powered snow tiller adapted to be propelled over the snow by a suitable vehicle and controlled by the operator of the vehicle, said tiller comprising:
a generally elongate tiller main frame;
an elongate generally rigid snow cutter assembly secured rotatably generally at each of its ends to the main frame and having a multiplicity of outstanding, snow cutting teeth;
a pair of reversible hydraulic motors adapted to together rotate the cutter assembly and secured to the tiller main frame in the vicinity of each end thereof;
a snow directing apron mounted upon the frame generally over the cutter bar assembly substantially the full length thereof and extending rearwardly downward to a generally horizontal trailing edge; and two elongate cutter segments of generally equal length and means connecting the two cutter segments generally coaxially together in flexible relationship, each segment having a multiplicity of generally normally outstanding snow cutting teeth and said connecting means comprising an axle member rigidly secured to and extending axially from an end of one of the cutter segments, and an elastic insert fixedly secured axially to the other one of the cutter segments within an end portion thereof, said elastic insert comprising an insert block of resilient elastic material disposed generally about the longitudinal axis of the cutter segment, having an outer longitudinal peripheral surface generally fixedly secured to the cutter segment, and having a perforation axially therethrough adapted to accept removably therein an end portion of the axle member in rotationally fixed relationship with the periphery of said perforation.

23. The tiller of claim 22 further comprising:

elongate snow splitting means secured to the tiller and extending substantially the full length of the snow cutter generally parallel thereto and generally above the snow cutting teeth, deflecting a portion of the cut snow forwardly of the reversely rotated cutter assembly for recutting.

24. The tiller of claim 23 wherein:

the snow splitter is adapted for securement to the tiller in selectable position thereon, so that the magnitude of the forwardly directed portion of cut snow is selectable.

25. A rotary powered snow tiller adapted to be propelled over the snow by a suitable vehicle and controlled by the operator of the vehicle, said tiller comprising:

a generally elongate tiller main frame;

an elongate generally rigid snow cutter assembly secured rotatably generally at each of its ends to the main frame and comprising two elongate cutter segments of generally equal length and means connecting the two cutter segments generally coaxially together in flexible relationship, each segment having a multiplicity of outstanding, snow cutting teeth and said connecting means comprising an axle member rigidly secured to and extending axially from an end of one of the cutter segments, and an elastic insert fixedly secured axially to the other one of the cutter segments within an end portion thereof, said elastic insert comprising an insert block of resilient elastic material disposed generally about the longitudinal axis of the cutter segment, having an outer longitudinal peripheral surface generally fixedly secured to the cutter segment, and having a perforation axially therethrough adapted to accept removably therein an end portion of the axle member in rotationally fixed relationship with the periphery of said perforation, the further cutter assembly supporting means comprising a cutter assembly center support member secured to the tiller main frame and a self aligning bearing secured to the center support member and adapted to support the axle member therein;

motor means adapted to rotate the snow cutter assembly;

a snow directing apron mounted upon the frame generally over the cutter assembly substantially the length thereof and extending rearwardly downward to a generally horizontal trailing edge; and means further supporting the snow cutter assembly rotatably upon the main frame in the vicinity of the longitudinal center thereof.

26. A rotary powered snow tiller adapted to be propelled over the snow by a suitable vehicle and controlled by the operator of the vehicle, said tiller comprising:

a generally elongate tiller main frame;

an elongate generally rigid snow cutter assembly secured rotatably generally at each of its ends to the main frame and having a multiplicity of outstanding snow cutting teeth, said cutter further having two elongate cutter segments of generally equal length;

a pair of motor means adapted to together rotate the snow cutter assembly, a one of said pair secured to the main frame in the vicinity of each one of the ends of said assembly;

a snow directing apron mounted upon the frame generally over the cutter assembly substantially the full length thereof and extending rearwardly downward to a generally horizontal trailing edge; said cutter assembly further comprising:

an elongate cutter segment coupling member;

a pair of elongate motor coupling members; and the two elongate cutter segments each comprises an elongate tubular member generally one half the length of the main frame, an elastic insert fixedly secured axially within each end of the tubular member, each of said inserts comprising a block of resilient elastic material disposed generally about the longitudinal axis of the tubular member, and having an outer longitudinal surface fixedly secured to said tubular member, the insert at the innermost end of each segment having an axial perforation therethrough adapted for securement of one of the end portions of the segment coupling member therein in fixed rotational relationship to the periphery of the perforation, and the insert at the outermost end of each segment having an axial perforation therethrough adapted for securement of one of the end portions of one of the motor coupling members therein in fixed rotational relationship to the periphery of the perforation.

27. A rotary powered snow tiller adapted to be propelled over the snow by a suitable vehicle and controlled by the operator of the vehicle, said tiller comprising:

a generally elongate tiller main frame;

an elongate generally rigid snow cutter assembly secured rotatably generally at each of its ends to the main frame, said cutter assembly comprising two elongate cutter segments of generally equal length, each segment having a multiplicity of generally normally outstanding snow cutting teeth;

an elongate cutter segment coupling member;

a pair of elongate motor coupling members; and the two elongate cutter segments each comprises an elongate tubular member generally one half the length of the main frame, an elastic insert fixedly secured axially within each end of the tubular member, each of said inserts comprising a block of resilient elastic material disposed generally about the longitudinal axis of the tubular member, and having an outer longitudinal surface fixedly secured to said tubular member, the insert at the innermost end of each segment having an axial perforation therethrough adapted for securement of one of the end portions of the segment coupling member therein in fixed rotational relationship to the periphery of the perforation, and the insert at the outermost end of each segment having an axial perforation therethrough adapted for securement of one of the end portions of one of the motor coupling members therein in fixed rotational relationship to the periphery of the perfo

28. The tiller of claim 27 further comprising:

elongate snow splitting means secured to the tiller and extending substantially the full length of the snow cutter generally parallel thereto and generally above the snow cutting teeth, deflecting a portion of the cut snow forwardly of the reversely rotated cutter assembly for recutting.

29. The snow cutter bar segment of claim 28 wherein the snow cutting teeth each comprises:

a monolithic plate member having a leading flat snow cutting portion disposed outstanding from and normally to a one of the tubular members, having a radially outermost end with generally square snow piercing corners, and a trailing flat portion joining the trailing edge of the leading portion and angled thereto to urge snow generally toward the innermost end of the cutter segment when forwardly rotated.

30. The snow cutter segment of claim 29, wherein:

the snow cutting teeth are disposed at equal intervals along each of two oppositely pitched intersecting helical paths around the tubular member its full length.

31. A rotary powered snow tiller adapted to be propelled over the snow by a suitable vehicle and controlled by the operator of the vehicle, said tiller comprising:

a generally elongate tiller main frame;

an elongate generally rigid snow cutter assembly secured rotatably generally at each of its ends to the main frame and comprising two elongate cutter segments of generally equal length, each segment having a multiplicity of outstanding, snow cutting teeth;

reversible motor means adapted to rotate the snow cutter assembly;

a snow directing apron mounted upon the frame generally over the cutter assembly substantially the length thereof and extending rearwardly downward to a generally horizontal trailing edge;

an elongate cutter segment coupling member;

a pair of elongate motor coupling members; and the two elongate cutter segments each comprises an elongate tubular member generally one half the length of the main frame, an elastic insert fixedly secured axially within each end of the tubular member, each of said inserts comprising a block of resilient elastic material disposed generally about the longitudinal axis of the tubular member, and having an outer longitudinal surface fixedly secured to said tubular member, the insert at the innermost end of each segment having an axial perforation therethrough adapted for securement of one of the end portions of the segment coupling member therein in fixed rotational relationship to the periphery of the perforation, and the insert at the outermost end of each segment having an axial perforation therethrough adapted for securement of one of the motor coupling members therein in fixed rotational relationship to the periphery of the perforation.

32. A snow cutter assembly for mounting upon the main frame of a snow tiller and comprising two elongate cutter segments of generally equal length each comprising:

an elongate tubular member generally one half the length of the main frame, said member being adapted at its outermost end for securement rotatably to the frame and having at its innermost end flexible bushing means for its connection generally coaxially to a similar cutter bar segment at the innermost end thereof in lateral and rotational flexing relationship thereto, and having a multiplicity of generally radially outstanding, snow cutting teeth secured thereto.

33. A snow cutter assembly for mounting upon the main frame of a snow tiller and comprising two elongate cutter segments of generally equal length each comprising:

an elongate tubular member generally one half the length of the main frame, said member being adapted at its outermost end for securement rotatably to the frame and at its innermost end for rotation transmitting, flexible securement to the innermost end of a similar cutter bar segment, and having a multiplicity of generally radially outstanding, snow cutting teeth secured thereto, wherein;

an outwardly extending axle segment is secured to the outermost end of the tubular member of each segment, said axle segment being adapted to extend through and engage a self aligning bearing provided on the frame of the tiller, and further adapted for engagement with a rotation producing motor;

one of the segments has an axle member secured rigidly to and extending coaxially from the innermost end of the tubular member thereof; and an elastic insert is fixedly secured axially within the innermost end of the tubular member of the other segment, said insert comprising a block of resilient elastic material disposed generally about the longitudinal axis of said tubular member, and having an outer longitudinal surface fixedly secured to said tubular member, and having an axial perforation therethrough adapted to accept said extending end portion of the axle member therein in rotationally fixed relationship with the periphery of said perforation.

34. A snow cutter assembly for mounting on the main frame of a snow tiller and comprising:

an elongate cutter segment coupling member;

a pair of elongate motor coupling members; and two elongate cutter segments each comprising an elongate tubular member generally one half the length of the main frame, an elastic insert fixedly secured axially within each end of the tubular member, each of said inserts comprising a block of resilient elastic material disposed generally about the longitudinal axis of the tubular member, and having an outer longitudinal surface fixedly secured to said tubular member, the insert at the innermost end of each segment having an axial perforation therethrough adapted for securement of one of the end portions of the segment coupling member therein in fixed rotational relationship to the periphery of the perforation, and the insert at the outermost end of each segment having an axial perforation therethrough adapted for securement of one of the end portions of one of the motor coupling members therein in fixed rotational relationship to the periphery of the perforation.

35. A rotary powered snow tiller adapted to be propelled over the snow by a suitable vehicle and controlled by the operator of the vehicle, said tiller comprising:

a generally elongate tiller main frame comprising a main frame tube generally parallel to, above and the length of the snow cutter assembly, and a pair of frame end plate members one of each rigidly secured generally perpendicularly to the main frame tube at each of the ends thereof to extend generally downwardly therefrom, each member being adapted for securement of a self aligning bearing thereto for rotationally supporting the adjacent end of the cutter assembly;

an elongate generally rigid snow cutter assembly secured rotatably generally at each of its ends to the main frame and comprising two elongate cutter segments of generally equal length and means connecting the two cutter segments generally coaxially together in flexible relationship, each segment having a multiplicity of outstanding, snow cutting teeth;

motor means adapted to rotate the snow cutter assembly;

a snow directing apron mounted upon the frame generally over the cutter assembly substantially the length thereof and extending rearwardly downward to a generally horizontal trailing edge;

an oscillation tube secured to the main frame tube pivotally about a tiller pivot axis generally parallel to, above and forward thereof;

an oscillation coupling rigidly secured to the oscillating frame tube at the center of the tiller, said coupling comprising a coupling body rigidly secured to the oscillating frame tube, an elongate generally horizontal spindle rotatably secured at each of its ends removably to the body and in a plane perpendicular to the oscillation tube, a pair of generally annular resilient bushings spaced apart along the spindle, and an elongate coupling tube disposed about the resilient bushings; and a rigid linking frame rigidly secured generally at its rearmost end to the coupling tube of the oscillation coupling, and having two pivot connectors spaced apart generally at the forward end of the linking frame to provide a horizontal pivot axis transverse to the direction of travel of the vehicle, so that the linking frame may be pivotally secured to the rearmost end of a towing frame provided upon and powered pivotally by the vehicle about a horizontal axis thereon parallel to the horizontal transverse pivoting axis of the linking frame to raise the tiller above the rearward portion of the vehicle to finally rest upon the towing frame.

36. The tiller of claim 35, further comprising:

adjustable means limiting the pivoting of the linking frame about it forward horizontal pivot axis when its forward end is urged downwardly by the rearward end of the towing frame of the vehicle; and adjustable means limiting the pivoting of the tiller main frame about the tiller pivot axis.

37. The tiller of claim 36, wherein the linking frame adjustable pivoting limiting means comprises:

a pair of spaced apart rigid pivot limiting arms rigidly secured to the linking frame and extending forwardly of the pivot connectors and above the towing frame; and a generally vertical locking adjusting screw disposed in a threaded bore through each pivot limiting arm generally at its forward end, so that the lower end of each screw bears against the towing frame when the rearward end thereof is urged downwardly by the vehicle.

* * * * *